US006023248A

United States Patent [19]

Lenormand et al.

[11] Patent Number: 6,023,248

[45] Date of Patent: Feb. 8, 2000

[54] MULTIPLEXED CHANNEL BEAM FORMING UNIT

[75] Inventors: Régis Lenormand, Blagnac; Daniel Renaud, Frouzins, both of France

[73] Assignee: Alcatel, Paris, France

[21] Appl. No.: 09/017,168

[22] Filed: Feb. 2, 1998

[30] Foreign Application Priority Data

Feb. 3, 1997 [FR] France ..... 97 01153

[51] Int. Cl.[7] ..... H01Q 1/28

[52] U.S. Cl. ..... 343/779; 445/422; 445/509; 445/517; 445/524; 343/781 R

[58] Field of Search ..... 343/779, 775, 343/776, 777, 781 R, 782, 781 P, 781 CA; 455/422, 509, 517, 524, 33.1; 322/2 R

[56] References Cited

U.S. PATENT DOCUMENTS

| | | | |
|---|---|---|---|
| 3,631,503 | 12/1971 | Tang et al. | 343/754 |
| 4,236,161 | 11/1980 | Ohm | 343/781 CA |
| 4,343,005 | 8/1982 | Han et al. | 343/781 P |
| 4,355,314 | 10/1982 | Ohm | 343/779 |
| 4,415,901 | 11/1983 | Gans | 343/754 |
| 4,479,129 | 10/1984 | Skahill | 343/781 P |
| 4,482,897 | 11/1984 | Dragone et al. | 343/779 |
| 4,595,929 | 6/1986 | Kreutel, Jr. | 343/781 P |
| 5,321,413 | 6/1994 | Lenormand | 343/755 |

FOREIGN PATENT DOCUMENTS

| | | |
|---|---|---|
| 0548876A1 | 6/1993 | European Pat. Off. . |
| 0638956A1 | 2/1995 | European Pat. Off. . |
| 4312693A1 | 11/1993 | Germany . |

OTHER PUBLICATIONS

R. M. Davis et al, "A Scanning Reflector Using an Off–Axis Space–Fed Phased–Array Fee", *IEEE Transactions On Antennas And Propagation,* vol. 39, No. 3, Mar. 1, 1991, pp. 391–400.

*Primary Examiner*—Don Wong
*Assistant Examiner*—James Clinger
*Attorney, Agent, or Firm*—Sughrue, Mion, Zinn, Macpeak & Seas, PLLC

[57] ABSTRACT

A unit for combining N channel signals produced by N respective separate sources, where N is an integer, comprises a collector array receiving the N channel signals in respective directions defined by array lobes associated with the collector array.

16 Claims, 3 Drawing Sheets

MULTIPLEXED CHANNEL BEAM FORMING UNIT

BACKGROUND OF THE INVENTION

1. Field of the Invention

The present invention concerns a unit for forming a beam that carries a plurality of frequency-division multiplexed channel signals. The unit multiplexes or combines the plurality of channel signals spatially into a common beam.

In one embodiment, the beam forming unit is part of an output stage of a satellite repeater. The satellite is a television signal broadcast satellite, for example, and produces a transmit beam covering an area on the ground.

2. Description of the Prior Art

In the prior art, the output stage typically comprises a plurality of amplifiers, each adapted to amplify a respective channel signal, and an output "multiplexer". The various channel signals are each amplified by a respective amplifier in order to minimize the distortion resulting from the non-linearity of the amplifiers used. The output "multiplexer" (OMUX) at the output of the amplifiers is as described in "Satellite Communications Systems", G. Maral and M. Bousquet, WILEY, Second Edition, pages 411 et seq. It comprises filters and a common waveguide for combining the channels after they are amplified and filtered individually.

To provide a low-loss coupling between the filters and the common waveguide, the filters are generally mounted directly on the common waveguide without using circulators, which have the disadvantage of causing high power losses. The filters and the common waveguide are in the form of cavities and each filter is coupled to the common waveguide via an iris or a slot. One end of the common waveguide is short-circuited and the other end delivers a combined signal carrying all of the multiplexed channel signals. This combined signal is transmitted by an antenna.

The losses induced in the portion between the outputs of the amplifiers and the antenna by a prior art beam forming unit of the above kind are relatively high, typically around 2 dB at high frequencies, for example in the Ka band. Also, an OMUX of the above kind is relatively heavy.

A first objective of the invention is to provide a beam forming unit, i.e. a unit for combining channel signals to be transmitted on the same beam, in which the power losses are small in comparison to the prior art. Another objective of the invention is to provide a unit for combining channel signals to be transmitted on the same beam that is lighter than the aforementioned prior art embodiment.

SUMMARY OF THE INVENTION

To this end a unit in accordance with the invention for combining N channel signals produced by N respective separate sources, where N is an integer, comprises collector array means receiving the N channel signals in respective directions defined by array lobes associated with the collector array means.

For transmitting the signals combined in this way the collector array means can be coupled to transmit array means that transmit the combined N channel signals.

A parabola disposed in an offset arrangement relative to the transmit array means can be used. The parabola reflects the combined N channel signals in the form of a beam.

The unit advantageously further includes focusing means for focusing the N channel signals onto the respective collector array means in said respective directions.

In one embodiment the focusing means are in the form of substantially concave reflective members each receiving a respective channel signal.

In a first variant the reflective members are carried by a parabola arc portion.

In a second variant the reflective members are carried by a paraboloid surface portion.

Other features and advantages of the present invention will become more clearly apparent upon reading the following description given with reference to the corresponding appended drawings.

DETAILED DESCRIPTION OF THE PREFERRED EMBODIMENT

Figure 1:
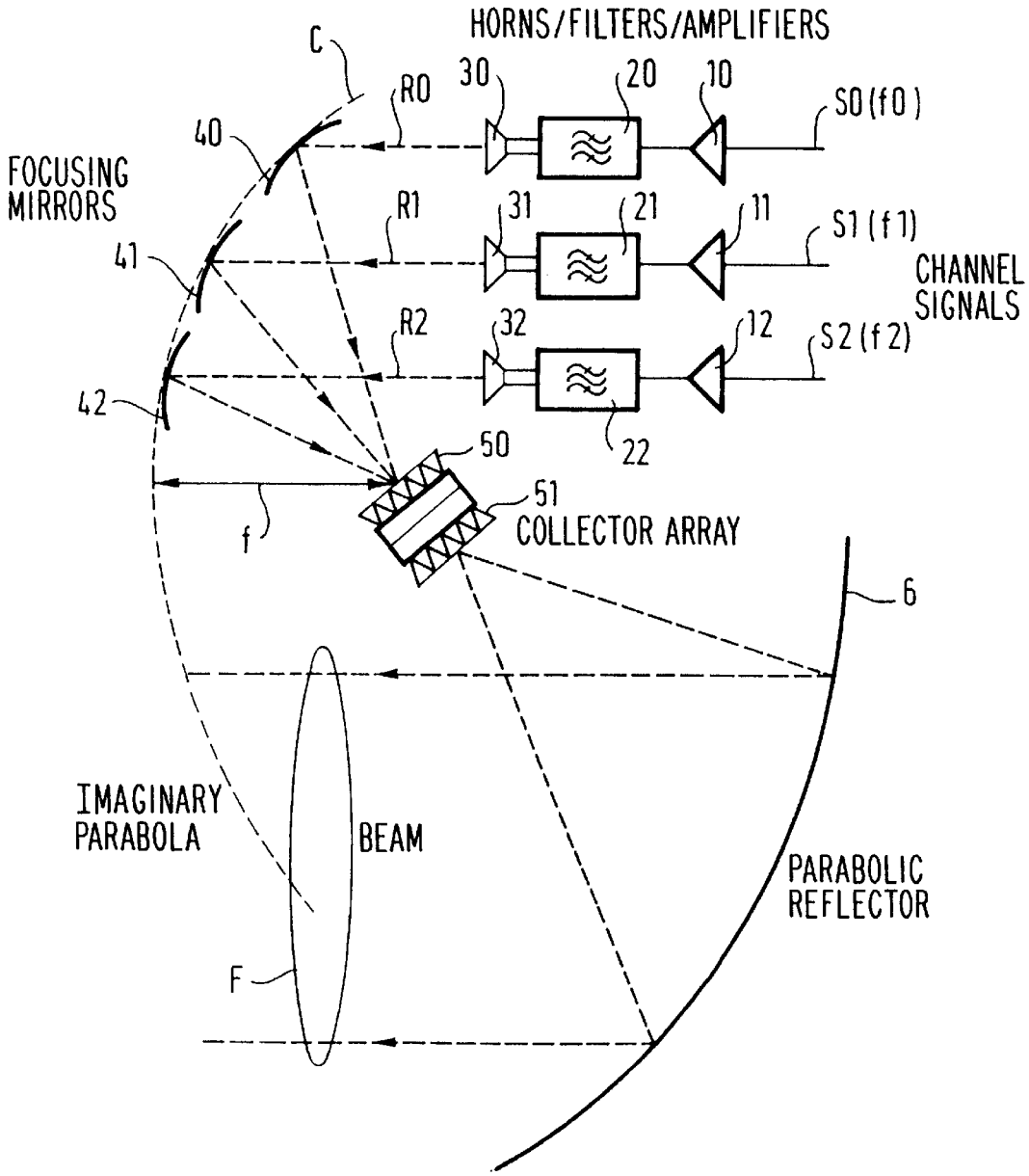
FIG. 1 is a block schematic of a unit in accordance with the invention for combining channel signals to be transmitted on the same beam.

Referring to FIG. 1, a beam forming unit in accordance with the invention is fed by N respective separate sources 30, 31 and 32, N being equal to 3 in FIG. 1. Each source 30, 31 and 32 is a horn, typically a small horn, for example. In a manner that is known in itself, a horn has an I/O or input guide portion and a radiating aperture of progressively increasing section. On the input side of each of the N sources 30, 31 and 32 is a respective cascade comprising a power amplifier 10, 11 and 12 and a bandpass filter 20, 21 and 22.

The N=3 channel signals S0, S1 and S2 to be transmitted in the same beam have respective center frequencies f0, f1 and f2. The separate frequencies f0, f1 and f2 are in the radio frequency band from 11.5 Giz to 12.5 GHz, for example. Each signal S0, S1 and S2 is fed to an input of a respective amplifier 10, 11 and 12 where it is amplified to a high power. Each resulting amplified signal is transmitted via a waveguide to an input of the corresponding bandpass filter 20, 21 and 22. Each filter is in the form of a cavity and filters the signal in the frequency band f0, f1 and f2 of the signal S0, S1 and S2 that it receives. The filters 20, 21 and 22 have outputs coupled to respective inputs of the horns 30, 31 and 32 via slots. The horns 30, 31 and 32 radiate respective waves R0, R1 and R2.

The waves R0, R1 and R2 are advantageously directed towards respective focusing means 40, 41 and 42 which are in the form of substantially concave reflective members, or mirrors, in the embodiment shown. The reflective members 40, 41 and 42 have a metallic surface reflecting the waves R0, R1 and R2 towards a collector array 50. The concave shape of the reflective members 40, 41 and 42 guarantees focusing of the energy of the various waves R0, R1 and R2 onto the collector array 50.

In the variant shown in FIG. 1, the N=3 reflective members 40, 41 and 42 are carried by an imaginary parabolic arc C, for example, the focal length f of which coincides with the collector array 50. In another variant shown schematically in FIG. 3 there are N=5 sources disposed in a cruciform arrangement. In this case the reflective members 40, 41, 42, 43 and 44 are carried by an imaginary paraboloid surface. Thus the centers of the various reflective members 40, 41, 42 (and where applicable 43 and 44) coincide with points on the same imaginary parabolic arc C (or an imaginary paraboloid surface) the focal length f of which coincides with the collector array 50.

Each wave R0, R1 and R2 is reflected and focused towards the collector array 50 in a particular direction by virtue of appropriate positioning and convergence of the reflective member 40, 41 and 42 that reflects the wave R0, R1 and R2. Note that the waves R0, R1 and R2 could be focused on the collector array 50 via a lens, without reflection.

The respective particular directions in which the waves R0, R1 and R2 are transmitted in accordance with the invention, after reflection, towards the collector array 50 will now be explained with reference to FIG. 2.

Figure 2:
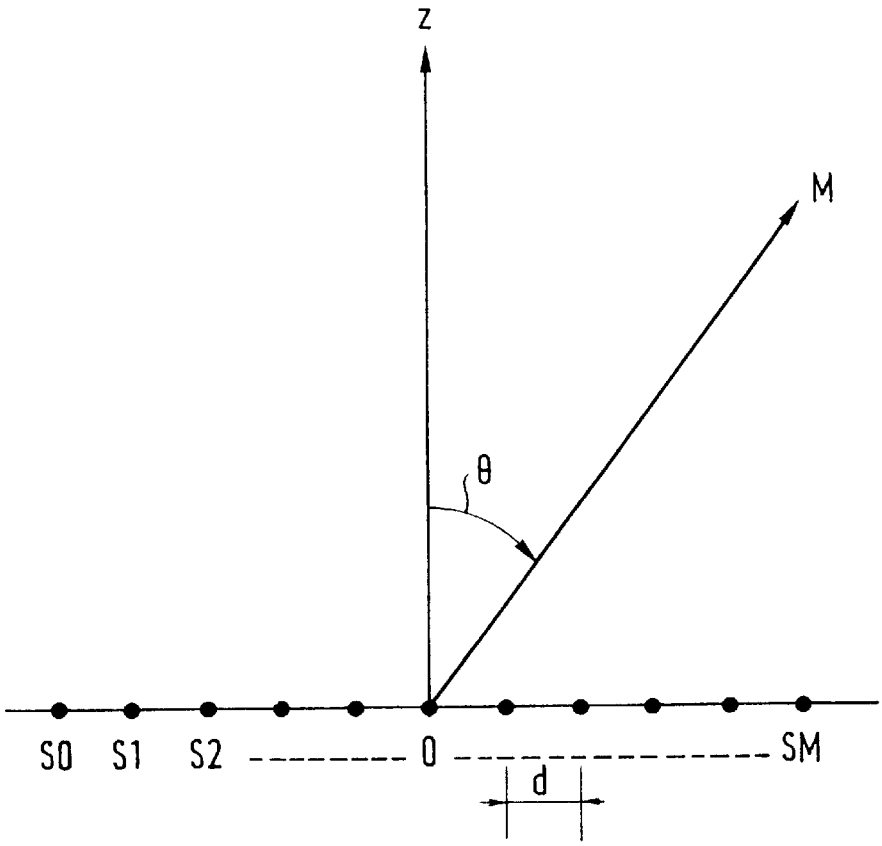
FIG. 2 is a representation of an array of sources used to explain the invention.

In a manner that is known in itself, a one-dimensional source array, of the type shown in FIG. 2, comprising (M+1) sources S0, S1, S2, . . . and SM energized in phase produces a radiation diagram with maxima defined by angles θ such that:

$$(2.\pi.d/\lambda).\sin(\theta)=2.m.\pi \quad (1)$$

that is:

$$\sin(\theta)=(m.\lambda)/d \quad (2)$$

where d is the distance between two adjacent sources, λ is the wavelength of the radiation, θ is the angle between the normal to the plane of the sources S0–SM and the direction concerned and m is a null, positive or negative integer.

The condition for no array lobes to appear is:

$$d<\lambda. \quad (3)$$

Conversely, if d>λ array lobes appear and the radiation diagram can include a plurality of maxima if the alignment is constituted of a plurality of sources S0–SM. It is the periodic nature of the array of sources that causes the array lobes to appear in the radiation diagram.

Referring to FIG. 1, the collector array 50 is in the form of an array of receive members. For example, the collector array 50 is constituted of (5×5) horns disposed in a matrix arrangement. The collector array 50 typically has a rectangular or triangular grid. The "periodic" geometrical structure of the collector array 50 is such that the array has the characteristics of an array of sources, i.e. it is able on transmission to generate a plurality of maxima, preferably of substantially the same amplitude, in respective separate directions. These directions correspond to the directions in which the waves R0, R1 and R2 are radiated after they are reflected at the reflective members 40, 41 and 42, respectively.

In our case, the collector array is a receive array but given the "reciprocal" nature of how the collector array 50 operates in transmission and in reception, this means that in reception the collector array 50 guarantees mixing or multiplexing without high losses between the various radiated waves or channel signals R0, R1 and R2. It must be remembered that the collector array 50 receives the channel signals R0, R1 and R2 in respective directions defined by theoretical transmit array lobes of the collector array means 50.

In the input or I/O waveguide portions of the horns of the collector array 50 the various channel signals R0, R1 and R2 are channelled without high losses. The I/O waveguide portion of each horn of the collector array 50 is coupled to a I/O waveguide portion of a corresponding horn of a transmit array 51. The transmit array 51 is constituted of (5×5) horns disposed in a matrix arrangement, for example. It produces the N=3 combined channel signals R0, R1 and R2.

In the embodiment shown, the combined channel signals transmitted by the transmit array 51 are reflected by a parabola portion 6. The transmit array 51 is disposed in an "offset" arrangement relative to the parabola 6, in a manner known to the skilled person, so that the beam F of channel signals reflected by the parabola portion is not directed towards the constituent members of the unit.

Although the preceding part of the description is limited to N=3 sources 30, 31 and 32, the invention can be extended to a higher number of sources. To this end, the various radiated waves directed towards the collector array 50 can either have coplanar axes or axes within a volume delimited by a cone. The latter option is the result of the fact that for an array of two-dimensional (i.e. not one dimensional) type sources, as shown in FIG. 2, the results obtained in respect of the array lobes are reproduced in both dimensions.

Note that operation of the unit of the invention is even more efficient if the frequencies f0, f1 and f2 of the channel signals R0, R1 and R2 are close together and lie in a band of high frequencies.

Figure 4:
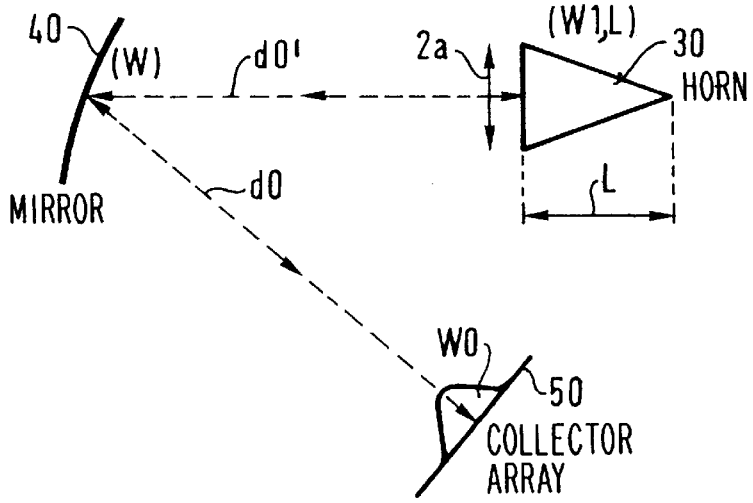
FIGS. 4 and 5 respectively show part of the unit of the invention and a field tube to explain the dimensions of the unit of the invention.

Referring to FIG. 4, the dimensional relations of the unit of the invention will now be specified. To be more precise, the relationship between the distances d0' and d0, d0' being the distance between the source 30 and the reflective element 40 and d0 being the distance between the reflective member 40, and the collector array 50, together with the convergence of the associated radiating member, here the member 40, will be defined for each horn source, such as the horn 30, for a given focal spot of spread W0 on the collector array 50. The focal spot on the collector array 50 must have a substantially plane equiphase surface, like that shown in FIG. 5. It can be shown that the operation of the unit can be approximated in a manner that is entirely appropriate by a Gaussian optical type wave model.

Each source, here the source 30, is in the form of a horn defined by a spreading of the field W1 at the horn aperture and a horn length L.

Figure 5:
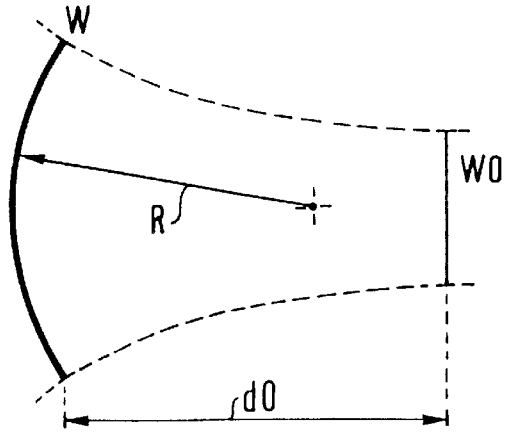

Referring to FIG. 5, for a field tube, the radius of curvature R and the spread W of the field distribution vary along all of the beam and an equiphase field area can be defined at any point by the pair (W, R), with the following relations:

$$R=d(1+\rho^2) \quad (4)$$

where $\rho=(2.R/k.W^2)$ and $W^2=(1+\rho^2)\ W0^2$ where W0 designates the minimum field spread.

For an equiphase field, and therefore an infinite radius of curvature, with a spread W0 on the collector array 50, it can be shown that the spread w(d0) on the reflective member is given by:

$$W(d0) = W0 \cdot \sqrt{1 + \left(\frac{2 \cdot d0}{k \cdot W0^2}\right)^2},$$

and that the radius of curvature R1 (d0) of the wave in the vicinity of the member 40 reflecting towards the collector array 50 is given by:

$$R1(d0)=k.(W0^2/2.d0)^2.[1+(2.d0/k.W0^2)^2]$$

taking as a reference d=0 on the collector array 50 and d=d0 on the reflective member 40.

The Gaussian wave at the horn aperture is characterized by the pair (W1, L) By stating that this wave, after propagation along the path of length d0' between the source 30 and the radiating member 40, must have as its parameters (W(d0), R1(d0)), then d0' can be expressed as a function of d0:

$$d0'(d0)=[k.W1.(\phi(d0)-\psi)]/[2.\ (1+\psi)] \quad (5)$$

where $$\phi(d0) = \sqrt{(1+\psi^2)\left(\frac{W(d0)}{W1}\right)^2 - 1},$$

and $\psi=k.W1^2/2.L$

The convergence C of the reflective member 40 is given by:

$$C=1/R1(d0)+1/R2(d0')$$

R2(d0) being the radius of curvature of the wave from the source 30 in the vicinity of the reflective member 40 and being defined by:

$$R2(d0)=k.(W(d0))^2/2.\ \phi(d0)$$

In the above, the sign of each radius of curvature must obey the following rule: said sign is positive if the wave diverges and negative if the wave converges.

Figure 3:
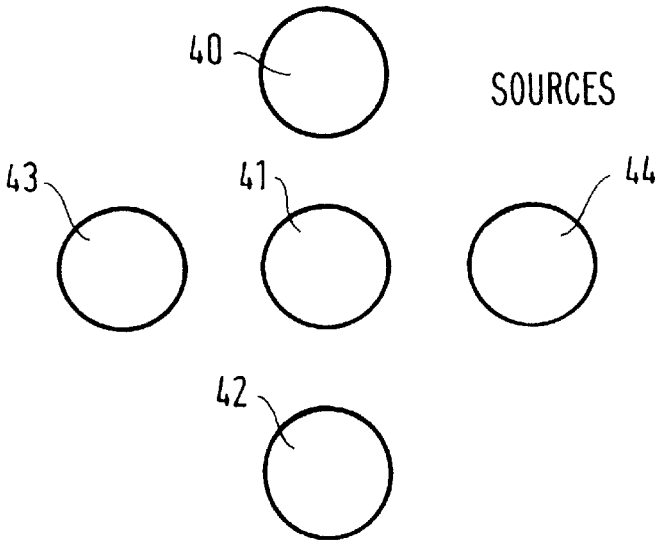
FIG. 3 is a plan view of reflective elements forming part of one embodiment of the unit of the invention.

The operation of the unit described above has been simulated in an embodiment where the collector array 50 comprises five rows of five horns. The (5×5) horns are disposed in a matrix arrangement and the section at the end of the flare of each horn is a square with a side length equal to 26.2 mm. There are N=5 sources 30, 31, 32, etc disposed in a cruciform arrangement. In this case, as shown in FIG. 3, the reflective members 40, 41, 42, 43 and 44 are carried by an imaginary paraboloid surface the focal length f of which coincides with the collector array 50. The transmit array 51 comprises 5×5 horns each fed by a respective corresponding horn of the collector array 50. The radiation diagram for each horn is modelled by a $\cos^{\tau}(\theta)$ diagram.

Four coupling "matrices" are given below. Each defines, for a given source, the coupling coefficients of each of the (5×5) horns of the collector array 50. Each coefficient is given in amplitude (dB) and in phase (°) in the form of a pair (X(dB); Y(°)).

The two matrices associated with the sources illuminating the mirrors 43 and 44 are identical because of the symmetrical disposition of these two sources relative to the collector array 50.

| FIRST MATRIX ASSOCIATED WITH SOURCE ILLUMINATING MIRROR 42 (FIG. 3) | | | | |
|---|---|---|---|---|
| (−28.6; 59.5) | (−18.9; 55.07) | (17.7; 55) | (−18.9; 55) | (−28.6; 59.5) |
| (−21.7; 50) | (−12.5; 44.9) | (−9.9; 41) | (−12.5; 44.9) | (−21.7; 50.4) |
| (−19.6; 47.1) | (−9.4; 49.4) | (−6.8; 51.5) | (−9.4; 49.4) | (−19.6; 47.1) |
| (−22.2; 43.6) | (−12.2; 52) | (−9.9; 56) | (−12.2; 52) | (−22.2; 43.6) |
| (−29.5; 35.8) | (−19.7; 44.1) | (−17.6; 48.2) | (−19.7; 44.1) | (−29.5; 35.8) |
| SECOND MATRIX ASSOCIATED WITH SOURCE ILLUMINATING MIRROR 41 (FIG. 3) | | | | |
| (−25.2; 140.9) | (−21.2; 141) | (−20.8; 132.8) | (−21.2.141) | (−25.2; 140.9) |
| (−21.3; 131.3) | (−12.7; 119.7) | (−10.2; 120.4) | (−12.7; 119.7) | (−21.3; 131.3) |
| (−18.5; 120.6) | (−8.9; 126.9) | (−6.8; 132.1) | (−8.9; 126.9) | (−18.5; 120.6) |
| (−21.2; 109.5) | (−12; 123) | (−10.1; 128.9) | (−12; 123) | (−21.2; 109.5) |
| (−31.2; 75.2) | (−21; 97.1) | (−19.1; 103.9) | (−21; 97.1) | (−31.2; 75.2) |
| THIRD MATRIX ASSOCIATED WITH SOURCE ILLUMINATING MIRROR 40 (FIG. 3) | | | | |
| (−23.6; 100.8) | (−19.2; 134.9) | (−17.7; 127.9) | (−19.2; 134.9) | (−23.6; 147.8) |
| (−20.8; 144.4) | (−13.4; 137.8) | (−11.5; 138.2) | (−13.4; 137.8) | (−20.8; 144.4) |
| (−18.7; 137.1) | (−10.4; 145) | (−8.6; 149.3) | (−10.4; 145) | (−18.7; 137.1) |
| (−19.1; 123.6) | (−10.9; 142.1) | (−9.32; 148.8) | (−10.9; 142.1) | (−19.1; 123.6) |
| (−22.4; 93.7) | (−14.6; 120.7) | (−13.1; 129.3) | (−14.6; 120.7) | (−22.4; 93.7) |
| THIRD MATRIX ASSOCIATED WITH TWO SOURCES RESPECTIVELY ILLUMINATING MIRRORS 43 and 44 (FIG. 3) | | | | |
| (−27.5; 100.8) | (−22.6; 106.9) | (−18.6; 122.3) | (−31; 166.3) | (−23.7; 177) |
| (−17.5; 115.6) | (−14.4; 129.8) | (−7.3; 120.8) | (−13.8; 101.4) | (−24.3; 101.7) |
| (−16.1; 140.6) | (−15.2; 155.1) | (−5.6; 134.1) | (−11.1; 115.8) | (−15.4; 102.8) |
| (−19.2; 134.1) | (−18.1; 143.4) | (−8.4; 130.6) | (−13.5; 120.7) | (−16.7; 112.8) |
| (−27.9; 115) | (−28.4; 120.6) | (−17.9; 104) | (−22.8; 94.2) | (−24.5; 84.3) |

The above matrices show the high consistency of the phase for each of the horns of the array, which guarantees correct operation of the unit of the invention.

Figure 6:
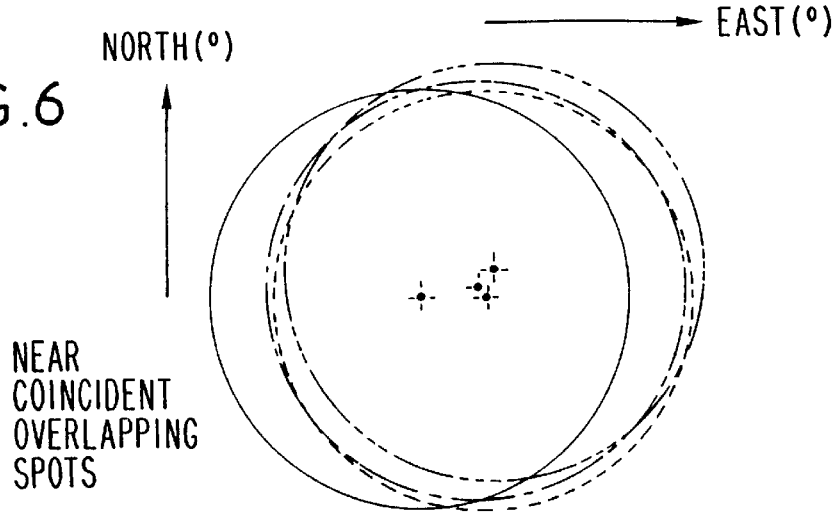
FIG. 6 shows a plurality of iso-level curves such as are obtained in accordance with the invention.

FIG. 6 shows the iso-level lines of the fields corresponding to the four matrices which show that spots formed by units of the invention are substantially concentric.

What is claimed:

1. A unit for combining N Channel signals having N different frequencies, respectively and produced by N respective separate sources, where N is an integer equal to or greater than 2, said unit comprising a collector array receiving said N channel signals according to N respective array lobes directions associated with said collector array, thereby combining said N channel signals into a common beam.

2. The unit claimed in claim 1 wherein said N channel signals are radio signals.

3. The unit claimed in claim 1 wherein said collector array means are coupled to transmit array means that transmit said combined N channel signals.

4. The unit claimed in claim 3 wherein said collector array means and said transmit array means are in the form of horns, each horn of said collector array being coupled to a respective horn of said transmit array via I/O waveguides.

5. A unit as claimed in claim 3 including parabola means disposed in an offset arrangement relative to said transmit array means and adapted to reflect said combined N channel signals in the form of a beam.

6. A unit as claimed in claim 1 including respective focusing means for focusing said N channel signals onto said collector array means in said respective directions.

7. The unit claimed in claim 6 wherein said focusing means are in the form of substantially concave reflective members each receiving a respective channel signal.

8. The unit claimed in claim 7 wherein said reflective members are carried by a parabola arc portion.

9. The unit claimed in claim 6 wherein said reflective members are carried by a paraboloid surface portion.

10. A satellite including a unit as claimed in claim 1.

11. A unit for combining N channel signals produced by N sources comprising:

N focusing elements receiving said N channel signals and focusing the N channel signals;

a collector array for receiving and combining said N focused channels;

a transmitter array coupled to said collector array for transmitting said N combined signals; and a parabolic reflector, disposed in an offset arrangement relative to said transmitter array, for receiving said transmitted N combined signals and reflecting said N combined signals as a beam.

12. The unit of claim 11, wherein said collector array and said transmitter array include horns, wherein each horn of said collector array is coupled to a respective horn of said transmitter array via input/output waveguides.

13. The unit of claim 11, wherein said N channel signals are radio signals.

14. The unit of claim 11, wherein said N focusing elements include substantially concave reflecting members each receiving a respective on of said N channel signals.

15. The unit of claim 14, further comprising a parabolic surface, wherein said reflecting members are arranged on said parabolic surface.

16. A satellite including:

N focusing elements receiving said N channel signals and focusing the N channel signals;

a collector array for receiving and combining said N focused channels;

a transmitter array coupled to said collector array for transmitting said N combined signals; and a parabolic reflector, disposed in an offset arrangement relative to said transmitter array, for receiving said transmitted N combined signals and reflecting said N combined signals as a beam.

* * * * *